US010472789B2

(12) United States Patent
Stork et al.

(10) Patent No.: US 10,472,789 B2
(45) Date of Patent: Nov. 12, 2019

(54) ARRANGEMENT WITH A HOLLOW MANDREL FOR INTRODUCING DRAINAGE RIBBONS IN A SUBSOIL

(71) Applicant: BAGGERMAATSCHAPPIJ BOSKALIS B.V., Papendrecht (NL)

(72) Inventors: Dries Cornelis Maria Stork, Papendrecht (NL); Jelle Groot, Papendrecht (NL)

(73) Assignee: BAGGERMAATSCHAPPIJ BOSKALIS B.V., Papendrecht (NL)

( * ) Notice: Subject to any disclaimer, the term of this patent is extended or adjusted under 35 U.S.C. 154(b) by 0 days.

(21) Appl. No.: 16/310,556

(22) PCT Filed: Jun. 19, 2017

(86) PCT No.: PCT/NL2017/050406

§ 371 (c)(1),
(2) Date: Dec. 17, 2018

(87) PCT Pub. No.: WO2017/217856

PCT Pub. Date: Dec. 21, 2017

(65) Prior Publication Data

US 2019/0177943 A1 Jun. 13, 2019

(30) Foreign Application Priority Data

Jun. 17, 2016 (NL) ..... 2016988

(51) Int. Cl.
*E02D 3/10* (2006.01)

(52) U.S. Cl.
CPC ..... *E02D 3/103* (2013.01)

(58) Field of Classification Search
CPC combination set(s) only.
See application file for complete search history.

(56) References Cited

U.S. PATENT DOCUMENTS 4,166,508 A * 9/1979 Van Den Berg ..... E02D 1/022 175/20
4,455,105 A * 6/1984 Juhola ..... E02B 11/00 405/36

(Continued)

FOREIGN PATENT DOCUMENTS

WO 2008082294 A1 7/2008

OTHER PUBLICATIONS

International Search Report from PCT Application No. PCT/NL2017/050406, dated Aug. 29, 2017.

(Continued)

*Primary Examiner* — Kyle Armstrong
(74) *Attorney, Agent, or Firm* — Workman Nydegger

(57) ABSTRACT

The invention relates to an arrangement for vertically introducing drainage ribbons into a subsoil, comprising an hollow mandrel and a drainage ribbon that is fed through the mandrel, wherein the mandrel comprises a permanent section with a first elongate mandrel profile and a mandrel drive, and a replacement section at the end of the mandrel, wherein the replacement section comprises a second elongate mandrel profile that is joint with the end of the first mandrel profile by means of a weld, a bottom face at the bottom end of the second mandrel profile, and a push bar and a spring that biases the push bar towards its extended position with respect to the bottom face, wherein the mandrel drive comprises a drive cable that extends through the hollow mandrel and that is at one end operatively connected with the push bar by means of a releasable coupling.

15 Claims, 6 Drawing Sheets

(56) References Cited

U.S. PATENT DOCUMENTS

| | | | | |
|---|---|---|---|---|
| 5,213,449 | A * | 5/1993 | Morris | E02D 3/10 173/149 |
| 5,800,090 | A * | 9/1998 | Goughnour | E02D 3/10 405/258.1 |
| 7,614,823 | B2 * | 11/2009 | Kim | E02D 3/103 405/232 |
| 7,736,091 | B2 * | 6/2010 | Morizot | E02D 3/10 405/232 |
| 8,985,898 | B2 * | 3/2015 | Tomlinson | E02D 3/103 405/247 |
| 2002/0098044 | A1 * | 7/2002 | White | E02D 11/00 405/232 |

OTHER PUBLICATIONS

Netherlands Search Report from NL Application No. NL 2016988, dated Oct. 4, 2016.

* cited by examiner

ARRANGEMENT WITH A HOLLOW MANDREL FOR INTRODUCING DRAINAGE RIBBONS IN A SUBSOIL

BACKGROUND

The invention relates to an arrangement for introducing an elongate, flexible element, such as a drainage element, in particular a drainage ribbon, into a subsoil.

Such arrangements are for instance employed for consolidating a slack, water-bearing subsoil by stimulated or forced drainage. The drainage ribbons have a water transporting construction or composition and are vertically inserted into the subsoil, whereby the water is more rapidly drained upwards. The subsoil consolidates then more rapidly and the bearing strength of the subsoil increases.

It is common use to introduce drainage ribbons into the subsoil by means of a hollow mandrel that is kept upright by means of a king post and that is vertically driven into and out of the subsoil while leaving the drainage ribbon behind that is fed through the hollow mandrel. The end of the introduced drainage ribbon is initially anchored into the subsoil by means of an elongate push bar. The push bar extends through the entire mandrel to be operated by an hydraulic cylinder at the top of the mandrel.

In practice, the bottom end of the mandrel undergoes the most wear due to the friction with solid particles in the subsoil. When the bottom of the known mandrel has worn out, the entire mandrel is replaced. This requires that the push bar is drawn out of the entire mandrel, which can only be performed with the king post laying horizontally. Therefore in practice the replacement of the mandrel is avoided by employing for each new drainage project a mandrel that has well enough reserve for that project, as a replacement operation may last multiple working days and it is impractical to ship a new mandrel to the project area due to its length. The employment of mandrels with well enough reserve to be on the safe side implies that mandrels are decommissioned before the technical lifetime has passed. This is disadvantageous from a cost perspective.

It is an object of the present invention to provide an arrangement for vertically introducing an elongate, flexible element into a subsoil by means of a hollow mandrel, wherein the technical lifetime of the mandrel can be optimized.

SUMMARY OF THE INVENTION

According to a first aspect, the invention provides an arrangement for vertically introducing an elongate, flexible element, such as a drainage element, in particular a drainage ribbon, into a subsoil, comprising a king post and an elongate hollow mandrel that is slideably guided along the king post in its longitudinal direction between a retracted position in which the mandrel extends above the subsoil and an extended position in which the mandrel penetrates the subsoil, wherein the elongate, flexible element is fed through the hollow mandrel, wherein the mandrel comprises a permanent section and respective replacement section at the end of the mandrel, wherein the permanent section comprises a first elongate and hollow mandrel profile and a mandrel drive, and wherein the replacement section comprises a second elongate and hollow mandrel profile that is attached to the end of the first mandrel profile, a bottom face at the bottom end of the second mandrel profile, a push bar that is slideably guided inside the second mandrel profile in its elongate direction between a retracted position with respect to the bottom face and an extended position in which it projects downwards from the bottom face, and a spring that biases the push bar towards its extended position, wherein the mandrel drive comprises an hydraulic drive cylinder that is mounted to the first mandrel profile, and a drive cable that extends through the hollow mandrel and that is at one end operatively connected with the hydraulic cylinder and that is at the opposite end operatively connected with the push bar by means of a releasable coupling.

The mandrel of the arrangement according to the invention comprises a permanent section and a respective replacement section of which the mandrel profiles are attached to each other. When the replacement section has worn out, it suffices to lift the vertical king post just enough to expose the transition between these sections. The replacement section can then be removed by separating the replacement section from the permanent section and by releasing the releasable coupling with the drive cable. Thereafter a same new replacement section can be installed by operatively connecting the drive cable to it by means of the releasable coupling and by attaching it to the permanent section. During this operation the drive cable hangs slack inside the permanent section. This replacement operation can be performed quickly by human operators during a drainage project, whereby the technical lifetime of the mandrel can be optimized. In this regard it is to be understood that the term 'permanent section' means that this section can be attached to multiple subsequent replacement sections before it will be decommissioned.

In an embodiment the second mandrel profile is attached to the end of the first mandrel profile by means of a weld, which forms a strong attachment that can only be released by cutting.

Alternatively the second mandrel profile is attached to the end of the first mandrel profile by means of bolts.

In an embodiment the drive cable and the elongate, flexible element extend parallel and adjacent to each other inside the hollow mandrel. As the drive cable is under tension it does not hamper the passage of the elongate, flexible element through the mandrel. The first mandrel profile and the second mandrel profile can thus be relatively slim when compared to prior art mandrels in which the elongate, flexible element need to be kept separated from the deflecting push bar over the entire length of the mandrel.

In an embodiment the replacement section comprises a first guide body inside the second mandrel profile behind the bottom face, wherein the first guide body is provided with a hole through which the push bar slideably extends.

In an embodiment the replacement section comprises a second guide body inside the second mandrel profile spaced apart from the bottom face, wherein the second guide body is provided with two holes through which two parallel slide rods extend that are connected to the push bar, and two push springs that extend around the slide rods and that are biased between the second guide body and the push bar.

In an embodiment thereof the drive cable extends between the slide rods.

In an embodiment the releasable coupling is located between the slide rods.

In an embodiment the replacement part comprises a cylindrical steel rod that is transversely attached to the push bar, wherein the replacement part comprises semicircular recesses that merge into the bottom face and that receives the cylindrical rod in the retracted position of the push bar. The end of the elongate, flexible element is released when the cylindrical rod is pushed out of the recess.

In an embodiment the arrangement comprises a steel guide profile along the king post in which the mandrel is slidably confined, wherein the guide profile comprises an elongate slot along its length and wherein the mandrel drive comprises a drive flange that project from the first mandrel profile and through the elongate slot, wherein the hydraulic drive cylinder is mounted to the drive flange and extends outside the guide profile. As the hydraulic drive cylinder extends outside the first mandrel profile and the guide profile, the first mandrel profile and the second mandrel profile can be relatively slim with respect to prior art mandrels.

In an embodiment the replacement section has a length that is less than one-fourth, preferably less than one-fifth of the entire length of the mandrel.

According to a second aspect, the invention provides a method for operating an arrangement for vertically introducing an elongate, flexible element, such as a drainage element, in particular a drainage ribbon, into a subsoil, wherein the arrangement comprises a king post and an elongate hollow mandrel that is slideably guided along the king post in its longitudinal direction between a retracted position in which the mandrel extends above the subsoil and an extended position in which the mandrel penetrates the subsoil, wherein the elongate, flexible element is fed through the hollow mandrel, wherein the mandrel comprises a permanent section and respective replacement section at the end of the mandrel, wherein the permanent section comprises a first elongate and hollow mandrel profile and a mandrel drive, and wherein the replacement section comprises a second elongate and hollow mandrel profile that is attached to the end of the first mandrel profile, a bottom face at the bottom end of the second mandrel profile, a push bar that is slideably guided inside the second mandrel profile in its elongate direction between a retracted position with respect to the bottom face and an extended position in which it projects downwards from the bottom face, and a spring that biases the push bar towards its extended position, wherein the mandrel drive comprises an hydraulic drive cylinder that is mounted to the first mandrel profile, and a drive cable that extends through the hollow mandrel and that is at one end operatively connected with the hydraulic drive cylinder and that is at the opposite end operatively connected with the push bar by means of a releasable coupling, wherein the method comprises vertically introducing a series of elongate, flexible elements into the subsoil by penetrating the subsoil with the mandrel and retracting it while leaving the introduced elongate, flexible element behind, wherein after introducing the series of elongate, flexible elements the replacement section is separated from the permanent section and the releasable coupling is released, and another replacement section is installed by operatively connecting the drive cable with the push bar by means of the releasable coupling and by attaching the replacement section to the permanent section. The method according to the invention can be performed during an operational project by operators on the subsoil, for example between subsequent introducing strokes of the mandrel and right at the moment that the replacement section has worn out in its entirety.

In an embodiment thereof the replacement section is separated from the permanent section by cutting and is attached to the permanent section by welding.

In an embodiment the releasable coupling is released by hand or by means of a hand tool.

In an embodiment the king post is kept vertically upright during the replacement of the replacement section while the drive cable remains extending through the permanent section of the hollow mandrel.

The various aspects and features described and shown in the specification can be applied, individually, wherever possible. These individual aspects, in particular the aspects and features described in the attached dependent claims, can be made subject of divisional patent applications.

BRIEF DESCRIPTION OF THE DRAWINGS

The invention will be elucidated on the basis of an exemplary embodiment shown in the attached drawings, in which.

DETAILED DESCRIPTION OF THE INVENTION

Figure 1:
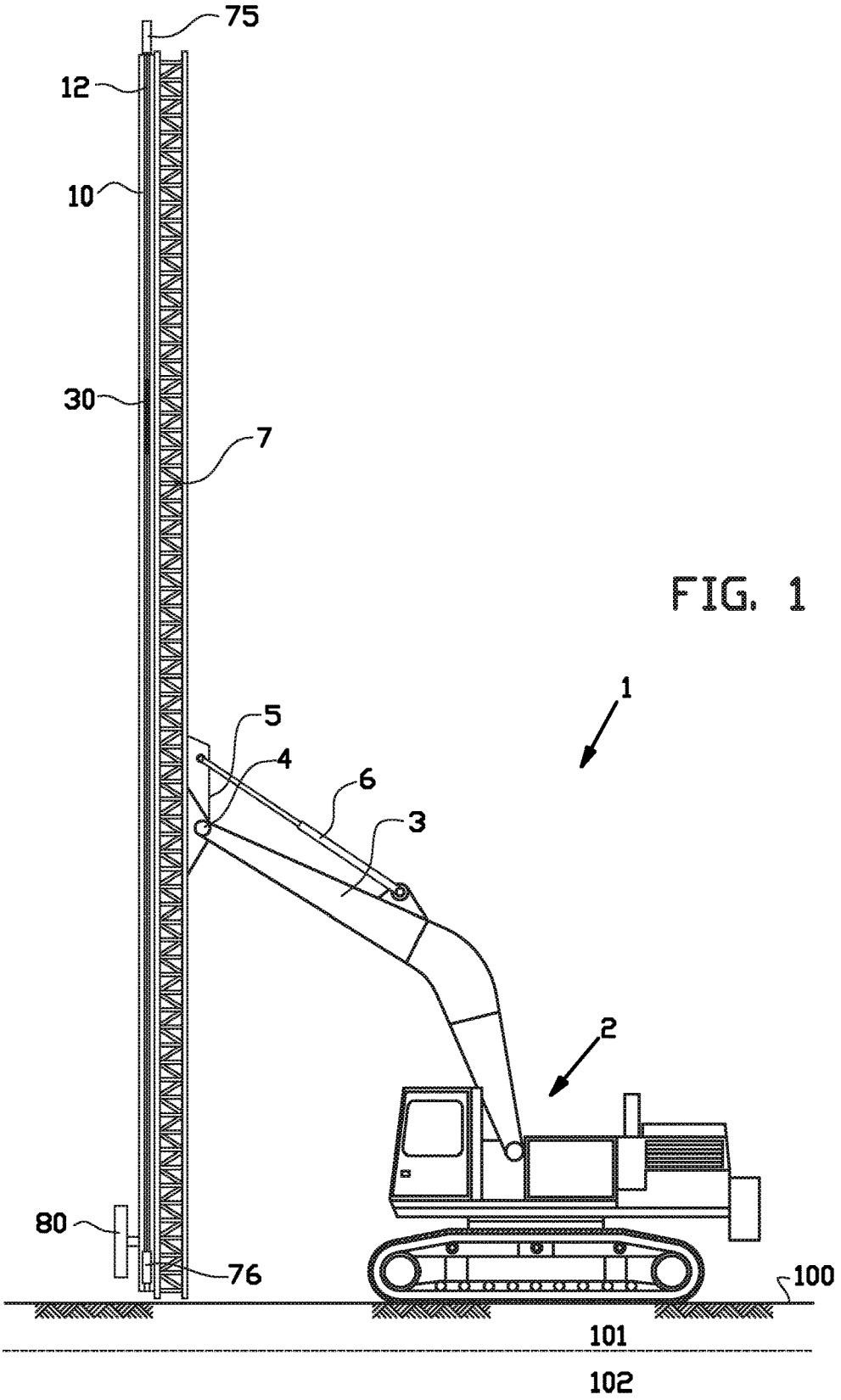
FIG. 1 shows an arrangement with a vertical king post for guiding a mandrel for vertically introducing drainage ribbons according to an embodiment of the invention.

FIG. 1 shows an arrangement 1 according to an embodiment of the invention for vertically introducing elongate, flexible elements, such as drainage elements, in particular drainage ribbons, into a subsoil 100. The arrangement 1 comprises an hydraulically driven crawler crane 2 that is displaceable over the subsoil 100. The crawler crane 2 comprises a hingeable boom 3 with an extreme end 4 to which a bracket 5 is fastened. The bracket 5 is hinged with respect to the boom 3 by means of an hydraulic cylinder 6. To the bracket 5 an elongate king post 7 is attached that is kept vertically upright during introducing the drainage ribbons.

Figure 2:
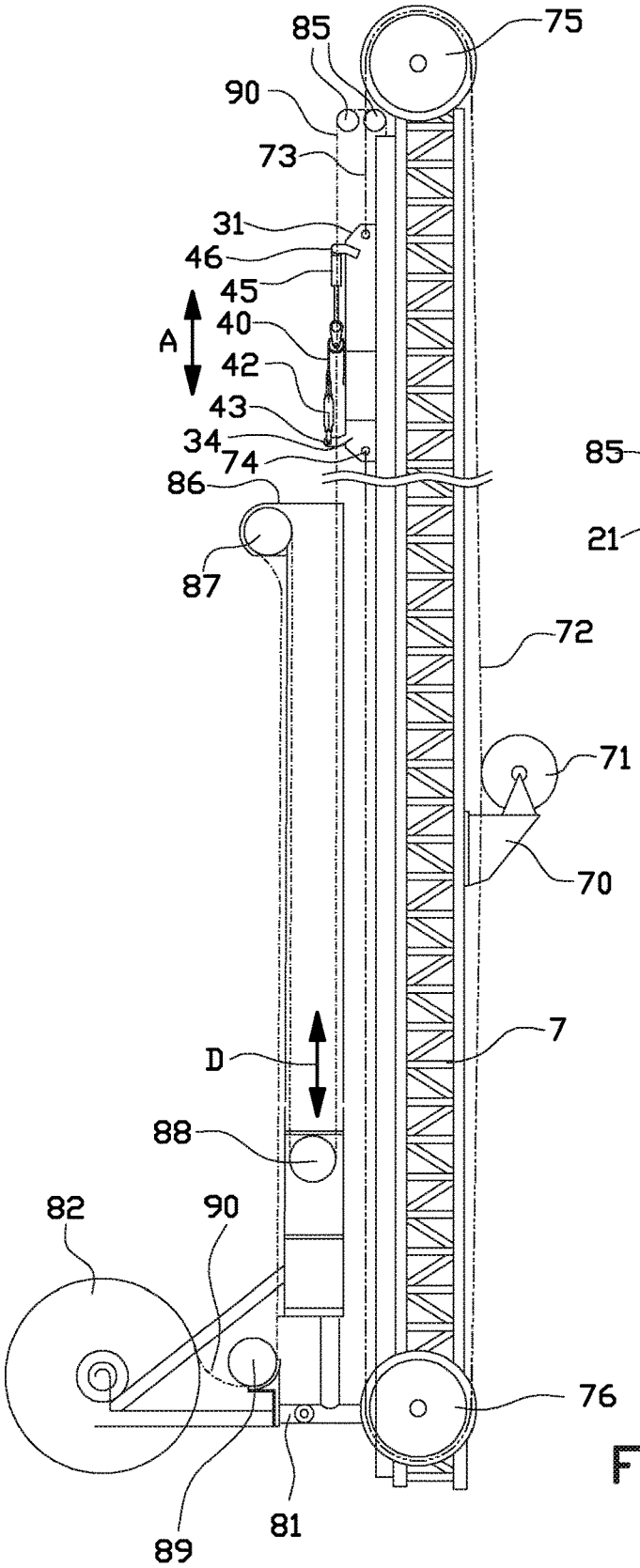
FIG. 2 is a schematic back view of the king post of FIG. 1 and the relevant components it carries.
Figure 3:
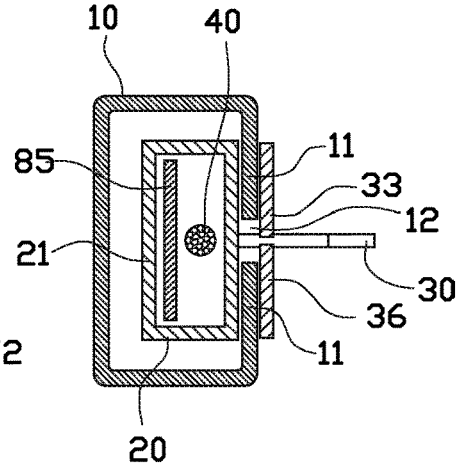
FIG. 3 is a cross section of the mandrel and a guiding profile carried by the king post of FIGS. 1 and 2 through which the mandrel is guided.

As schematically shown in FIG. 2, the arrangement 1 comprises along the entire length of the king post 7 an elongate steel guiding profile 10 that is mounted thereto. As best shown in FIG. 3, the guiding profile 10 is hollow and has a rectangular cross section. At the side facing away from the king post 7 the guiding profile 10 comprises two facing flanges 11 that define an elongate slot 12 over the entire length of the guiding profile 10.

Figure 4A:
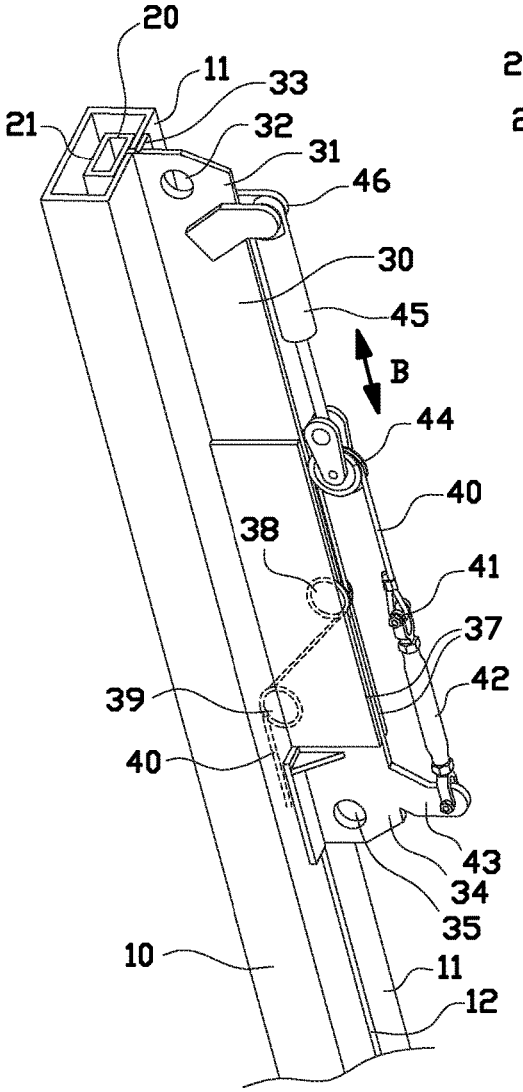
FIGS. 4A and 4B are details of the upper end of the mandrel and the guiding profile as shown in FIG. 2.
Figure 4B:
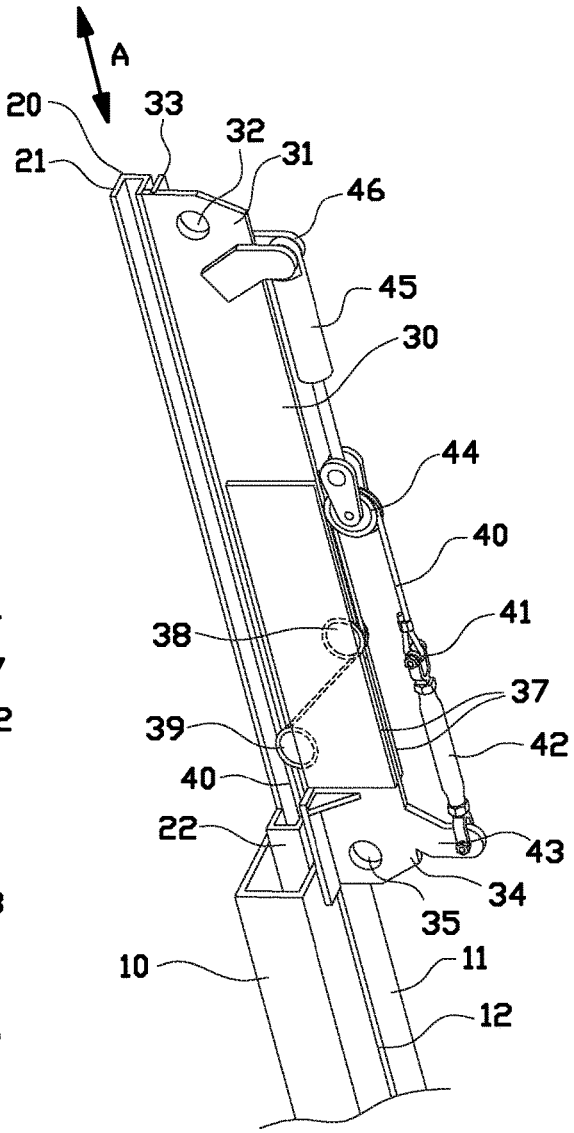

As best shown in FIGS. 3 and 4A, the arrangement 1 comprises a lance or mandrel 20 having a first elongate steel mandrel profile 21 that is hollow and that has a rectangular cross section. The first mandrel profile 21 is slideably confined within the guiding profile 10. The mandrel 20 comprises a mandrel drive 30 against the upper end of the first mandrel profile 21. The mandrel drive 30 comprises an upper drive flange 31 with an upper connecting eye 32 and a lower drive flange 34 with a lower connecting eye 35 that are welded spaced apart from each other against the first mandrel profile 21 and that project through the elongate slot 12 of the guiding profile 10. The mandrel drive 30 comprises an upper slide shoe 33 against the upper drive flange 31 and a lower slide shoe 36 against the lower drive flange 34 for slideable confinement of one of the flanges 11 of the guiding profile 10.

The upper drive flange 31 and the lower drive flange 34 are positioned spaced apart from each other, wherein the flanges 31, 34 are interconnected with two side plates 37 that carry two pulleys 38, 39 in between. The mandrel drive 30 is provided with a steel drive cable 40 of which the upper end 41 is connected to a lug of the lower drive flange 34 via an adjustable cable tensioner 42. The drive cable 40 runs along a drive pulley 44 at the end of an hydraulic drive drive cylinder 45 that is connected to a lug 46 of the upper drive flange 31, and subsequently along the pulleys 38, 39 between the side plates 38 into the first mandrel profile 21.

Figure 5:
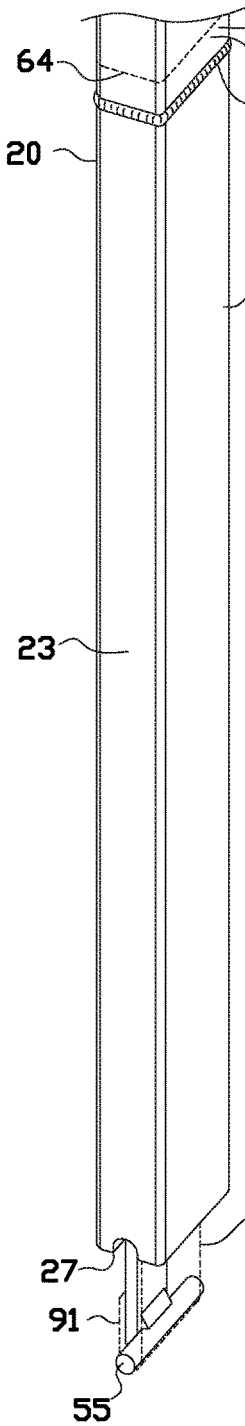
FIGS. 5, 6A and 6B are details of the lower end of the mandrel as shown in FIG. 2.
Figure 6A:
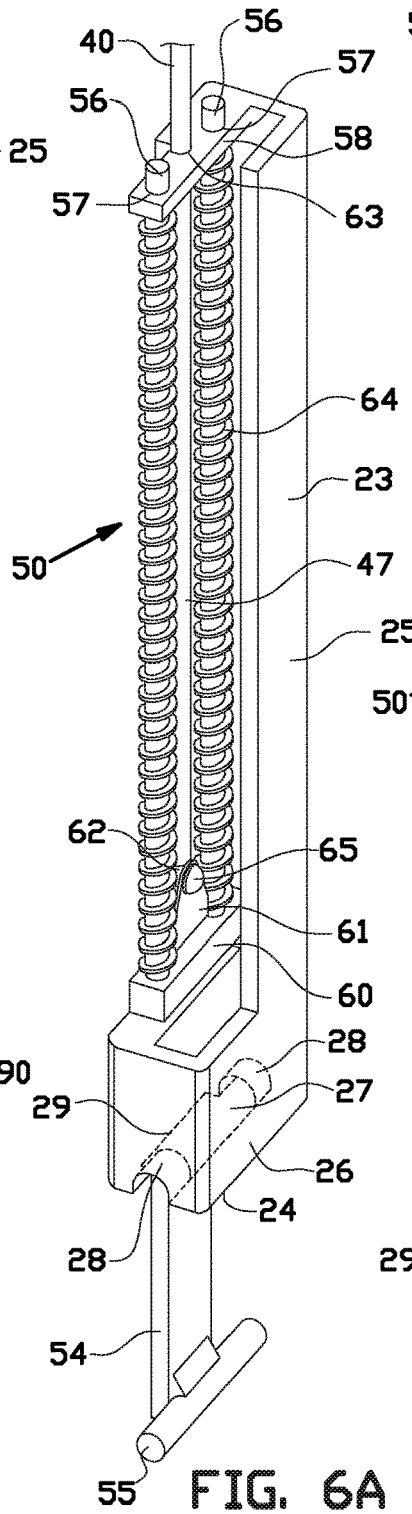
Figure 6B:
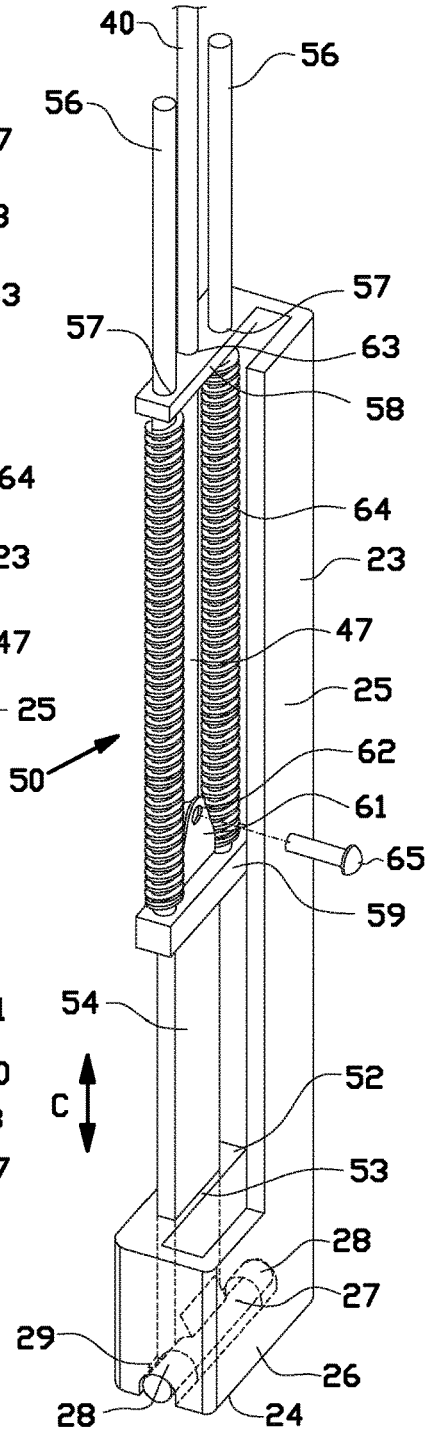

FIG. 5 shows the lower end of the mandrel 20 in more detail. The mandrel 20 comprises a permanent section 22 that forms the majority of the entire length of the mandrel 20 up to the mandrel drive 30, and a shorter wear section or replacement section 23 that is mounted to the permanent section 22 by means of a weld 24. The replacement section extends over about one fifth of the entire length of the mandrel 20. FIGS. 6A and 6B show the separate replacement section 23 before it is welded to the permanent section 22. The replacement section 23 carries a release mechanism 50 for the drainage ribbon.

The replacement section 23 comprises a second mandrel profile 25 with the same cross section as the first mandrel profile 21, and a bottom face 26 in which an elongate slot 27 is provided. At the ends the slot 27 is bounded by semicircular recessions 28 in de smallest side walls of the second mandrel profile 25, and at one longitudinal side the slot 27 comprises a shorter rectangular side extension 29. Straight above this side extension 29 the replacement section 23 comprises a steel internal first guide body 52 with a rectangular slot 53 through which a steel push bar 54 is slidably guided. At the bottom side a steel cylindrical rod 55 is welded against the push bar 54. The release mechanism 50 comprises two parallel steel slide rods 56 that slideably extend through guide holes 57 in a steel internal second guide body 58 inside the second mandrel profile 25. The slide rods 56 are welded to a steel push body 59 that is welded to the top side of the push bar 54. The push body 59 comprises a lug 61 with an eye 62 between the slide rods 56. Two push springs 64 extend around the slide rods 56 and are biased between the second guide body 58 and the push body 59.

As shown in FIGS. 3, 6A and 6B, the drive cable 40 extends through the first mandrel profile 21 and the second mandrel profile 25, wherein its lower end 47 passes through a guide hole 63 of the second guide body 58 and is connected to the lug 61 of the push body 59 by means of a reversible releasable coupling, in this example a pin 65 that is inserted in the eye 62 of the push body 59 and a not shown end loop at the lower end 47 of the drive cable 40. The releasable coupling can be made and released by hand or with hand tools, such as a wrench, a hammer or pincers. When the hydraulic drive cylinder 45 is retracted in direction B as shown in FIG. 4A, the push bar 54 is retracted in direction C against the bias of the push springs 64 until the cylindrical rod 55 is firmly engaged within the semicircular recessions 28 as shown in FIG. 6B. The cylindrical rod 54 is received with a total clearance at the elongate sides of about 1-3 millimeters. When the hydraulic drive cylinder 45 is extended in direction B, the biased push springs 64 firmly push the push bar 54 out in direction C until the push body 59 abuts the first guide body 52 at the bottom of the mandrel 20.

As shown in FIG. 2, the arrangement comprises a driven winch 71 on a frame 70 that is mounted to the king post 7. The winch 71 drives a drive cable 72 that is guided along an upper drive wheel 75 and a lower drive wheel 76 on the king post 7. The upper end 73 is connected to the upper connecting eye 32 and the lower end 74 is connected to the lower connecting eye 35 of the mandrel drive 30. By rotation of the winch 71 the mandrel 20 is slid in direction A through the guiding profile 10 between a retracted position in which only a portion of the replacement section 23 projects from the bottom of the guiding profile 10 while above the subsoil 100, and an extended position in which the mandrel 20 has penetrated the subsoil.

As shown in FIGS. 1 and 2, the arrangement 1 comprises a supply device 80 for drainage ribbon 90. The drainage ribbon has a water transporting construction or composition. The supply device 80 comprises a stock reel 82 on a frame 81 that is mounted to the king post 7. The supply device 80 furthermore comprises an upper wheel 87 and a lower wheel 89 on the frame 81, a displaceable wheel 88 that is pushed downwards under gravity or by means of non-shown tensioners, and top wheels 85 at the top of the king post 7. The drainage ribbon 90 extends from the stock reel 82 and is fed along the lower wheel 89, the upper wheel 87, the displaceable wheel 88, the top wheels 85 and through the mandrel 20. As shown in FIG. 5, the drainage ribbon 90 ends up to the cylindrical rod 55 at the bottom of the mandrel 20, wherein some over length 91 may be folded back around the cylindrical rod 55 itself or around the bottom face 26. As best shown in FIG. 3, the mandrel 20 contains inside up to the replacement section only the drainage ribbon 90 and the drive cable 40 extending parallel to each other, whereby the mandrel can be relatively slim with respect to prior art mandrels.

Figure 7A:
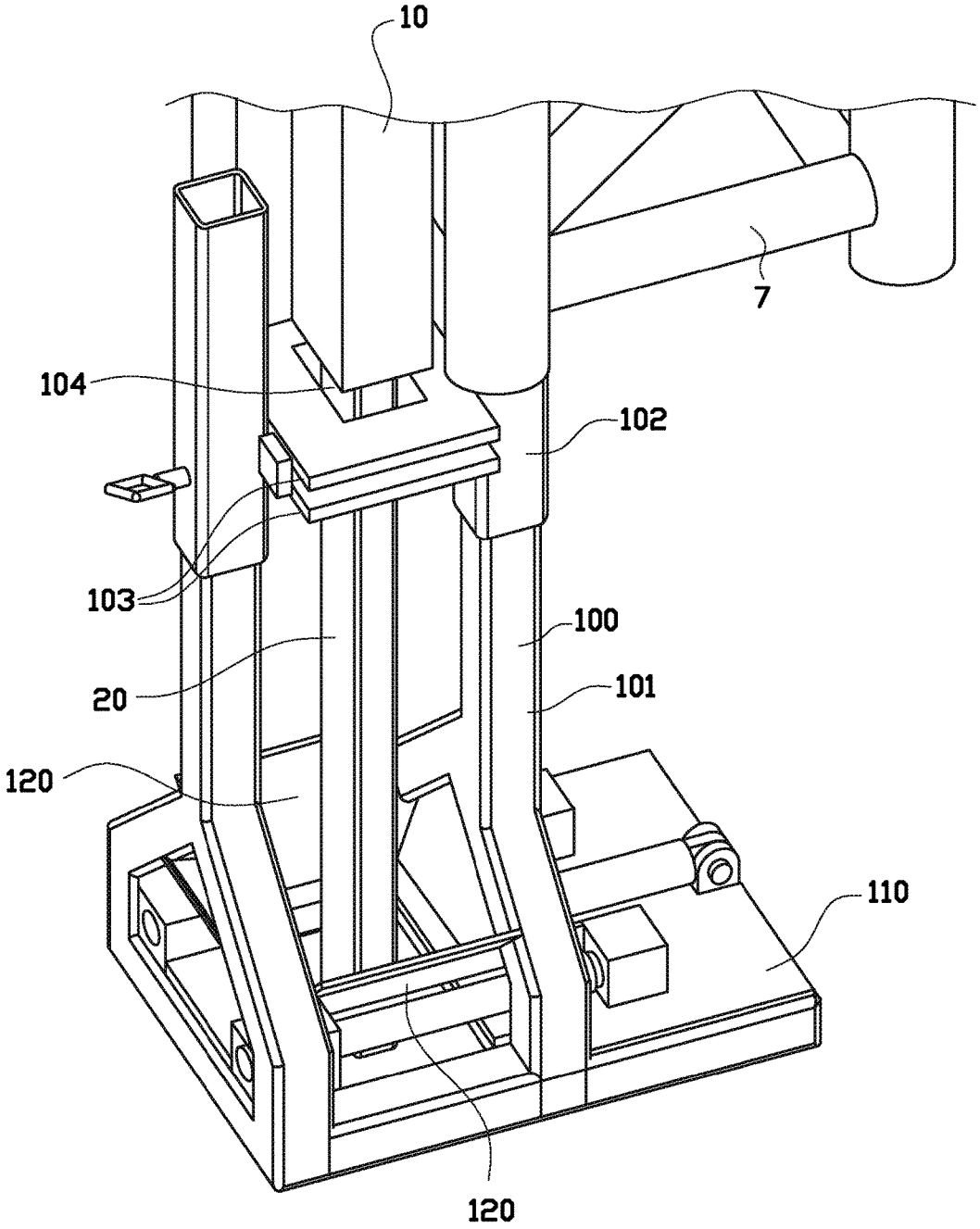
FIGS. 7A and 7B show a support frame at the bottom side of the king post of FIG. 1 and details of the drainage ribbon cutter thereof.
Figure 7B:
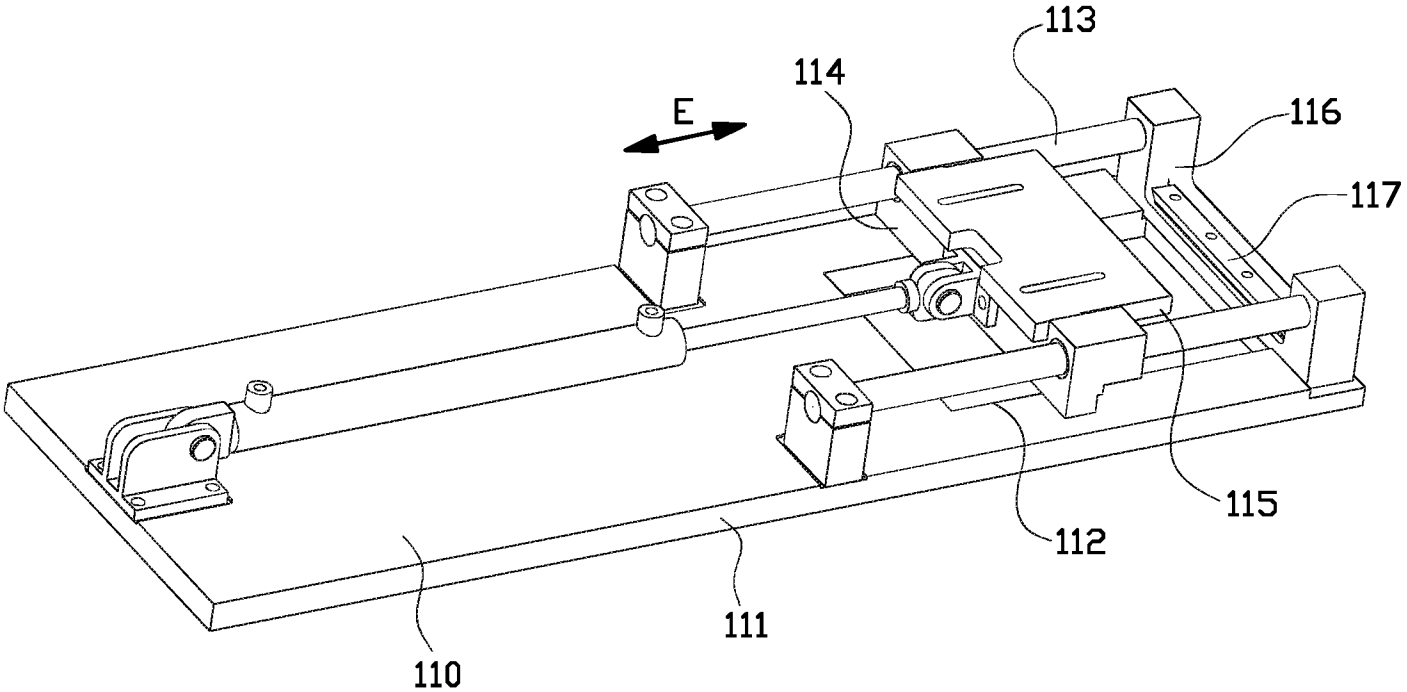

As shown in FIG. 7A, the arrangement 1 comprises a steel support frame 100 that is mounted to the bottom of the king post 7. The support frame 100 comprises two feet 101 at the opposite sides of the mandrel 20 that are connected to a foot 110. The foot 11 comprises a base plate 111 in which an opening 112 is provided for passage of the mandrel 20. The support frame 100 comprises a first knife holder 116 on the base plate 111 that carries a first knife 117, and two parallel slide rods 113 for sliding guidance of a second knife holder 114 that carries a second knife 115. The second knife 115 is thereby movable in horizontal direction E towards the first knife 117 by means of an hydraulic cylinder to cut off the drainage ribbon 90. The support frame 100 furthermore comprises two steel scrapers 113 to remove soil from the mandrel 20 and four oblique cover plates 120 to prevent that the soil that is scraped off falls on the knives 115, 117.

In operation of the arrangement 1, sections of drainage ribbons 90 are subsequently inserted in the subsoil 100. The operation starts with the mandrel 20 fully retracted and the hydraulic drive cylinder 45 retracted. The drainage ribbon 90 that is fed through the mandrel 20 is positioned such that the end projects from the bottom face 26. Subsequently the hydraulic drive cylinder 45 is retracted in direction B whereby the cylindrical rod 55 is firmly engaged within the semicircular recessions 28. In this position the elongate slot 27 in the bottom face 26 is closed off by the cylindrical rod 55 while the drainage ribbon 90 is firmly engaged. Subsequently the winch 71 is powered whereby the mandrel 20 penetrates the subsoil 100. In this stroke multiple soil layers 101, 102 may be penetrated until the soil layer to be drained is reached. At the end of the penetration stroke the hydraulic drive cylinder 45 is retracted whereby the push springs 64 push the push bar 54 and the cylindrical rod 55 out of the bottom face 26. Depending on the resistance of the subsoil, the cylindrical rod 55 further penetrates the subsoil or the cylindrical rod 55 remains at this depth while the mandrel 20 is retracted again in direction A. In both cases the drainage ribbon 90 is anchored, whereby it remains vertically in the subsoil when the mandrel 20 is fully retracted. Finally the drainage ribbon 90 is cut off above the subsoil 100 by means of the knives 115, 117 and a new penetration cycle starts.

The mandrel 20 is subject to substantive wear due to the friction with solid particles in the subsoil 100. In particular the replacement section 23 undergoes the most wear as it travels the longest distances into the subsoil 100. When the replacement section 23 has worn out, a transverse cut 64 is made in the mandrel 20 near the weld 24, preferably in the first mandrel profile 21, and subsequently the pin 65 is pulled out whereby the coupling with the drive cable 40 is released. The drive cable 40 remains hanging downward through the remainder of the mandrel 20. Subsequently a new replacement section 23 is installed by coupling the drive cable 40 by mean of the pin 65 and by welding it to the permanent section 22 of the mandrel 20. The exchange of replacement sections 23 can be executed even during a drainage project, as is can be performed quickly and safely by human operators on the subsoil 100 while the king post 7 remains vertical upright.

It is to be understood that the above description is included to illustrate the operation of the preferred embodiments and is not meant to limit the scope of the invention. From the above discussion, many variations will be apparent to one skilled in the art that would yet be encompassed by the scope of the present invention.

The invention claimed is:

1. An arrangement for vertically introducing an elongate, flexible element, such as a drainage element, in particular a drainage ribbon, into a subsoil, comprising a king post and an elongate hollow mandrel that is slideably guided along the king post in its longitudinal direction between a retracted position in which the mandrel extends above the subsoil and an extended position in which the mandrel penetrates the subsoil, wherein the elongate, flexible element is fed through the hollow mandrel, wherein the mandrel comprises a permanent section and respective replacement section at the end of the mandrel, wherein the permanent section comprises a first elongate and hollow mandrel profile and a mandrel drive, and wherein the replacement section comprises a second elongate and hollow mandrel profile that is attached to the end of the first mandrel profile, a bottom face at the bottom end of the second mandrel profile, a push bar that is slideably guided inside the second mandrel profile in its elongate direction between a retracted position with respect to the bottom face and an extended position in which it projects downwards from the bottom face, and a spring that biases the push bar towards its extended position, wherein the mandrel drive comprises an hydraulic drive cylinder that is mounted to the first mandrel profile, and a drive cable that extends through the hollow mandrel and that is at one end operatively connected with the hydraulic drive cylinder and that is at the opposite end operatively connected with the push bar by means of a releasable coupling, wherein the replacement section is configured to be replaced by separating it from the permanent section and releasing the releasable coupling.

2. The arrangement according to claim 1, wherein the second mandrel profile is attached to the end of the first mandrel profile by means of a weld.

3. The arrangement according to claim 1, wherein the drive cable and the elongate, flexible element extend parallel and adjacent to each other inside the hollow mandrel.

4. The arrangement according to claim 1, wherein the replacement section comprises a first guide body inside the second mandrel profile behind the bottom face, wherein the first guide body is provided with a hole through which the push bar slideably extends.

5. The arrangement according to claim 1, wherein the replacement section comprises a second guide body inside the second mandrel profile spaced apart from the bottom face, wherein the second guide body is provided with two holes through which two parallel slide rods extend that are connected to the push bar, and two push springs that extend around the slide rods and that are biased between the second guide body and the push bar.

6. The arrangement according to claim 5, wherein the drive cable extends between the slide rods.

7. The arrangement according to claim 5, wherein the releasable coupling is located between the slide rods.

8. The arrangement according to claim 1, wherein the replacement part comprises a cylindrical steel rod that is transversely attached to the push bar, wherein the replacement part comprises semicircular recesses that merge into the bottom face and that receives the cylindrical rod in the retracted position of the push bar.

9. The arrangement according to claim 1, comprising a steel guide profile along the king post in which the mandrel is slideably confined, wherein the guide profile comprises an elongate slot along its length and wherein the mandrel drive comprises a drive flange that projects from the first mandrel profile and through the elongate slot, wherein the hydraulic drive cylinder is mounted to the drive flange and extends outside the guide profile.

10. The arrangement according to claim 1, wherein the replacement section has a length that is less than one-fourth of the entire length of the mandrel.

11. The arrangement according to claim 10, wherein the replacement section has a length that is less than one-fifth of the entire length of the mandrel.

12. A method for operating an arrangement for vertically introducing an elongate, flexible element, such as a drainage element, in particular a drainage ribbon, into a subsoil, wherein the arrangement comprises a king post and an elongate hollow mandrel that is slideably guided along the king post in its longitudinal direction between a retracted position in which the mandrel extends above the subsoil and an extended position in which the mandrel penetrates the subsoil, wherein the elongate, flexible element is fed through the hollow mandrel, wherein the mandrel comprises a permanent section and respective replacement section at the end of the mandrel, wherein the permanent section comprises a first elongate and hollow mandrel profile and a mandrel drive, and wherein the replacement section comprises a second elongate and hollow mandrel profile that is attached to the end of the first mandrel profile, a bottom face at the bottom end of the second mandrel profile, a push bar that is slideably guided inside the second mandrel profile in its elongate direction between a retracted position with respect to the bottom face and an extended position in which it projects downwards from the bottom face, and a spring that biases the push bar towards its extended position, wherein the mandrel drive comprises an hydraulic drive cylinder that is mounted to the first mandrel profile, and a drive cable that extends through the hollow mandrel and that is at one end operatively connected with the hydraulic drive cylinder and that is at the opposite end operatively connected with the push bar by means of a releasable coupling, wherein the method comprises vertically introducing a series of elongate, flexible elements into the subsoil by penetrating the subsoil with the mandrel and retracting it while leaving the introduced elongate, flexible element behind, wherein after introducing the series of elongate, flexible elements the replacement section is separated from the permanent section and the releasable coupling is released, and another replacement section is installed by operatively connecting the drive cable with the push bar by means of the releasable coupling and by attaching the replacement section to the permanent section.

13. The method according to claim 12, wherein the replacement section is separated from the permanent section by cutting and is attached to the permanent section by welding.

14. The method according to claim 12, wherein the releasable coupling is released by hand or by means of a hand tool.

15. The method according to claim 12, wherein during the replacement of the replacement section the king post is kept vertically upright and the drive cable remains extending through the permanent section of the hollow mandrel.

* * * * *